US005505444A

United States Patent [19]

Bouclin, Jr.

[11] Patent Number: 5,505,444

[45] Date of Patent: Apr. 9, 1996

[54] GOLF TEE

[76] Inventor: Edward W. Bouclin, Jr., 201 Blair Dr., East Greenwich, R.I. 02818

[21] Appl. No.: 417,000

[22] Filed: Apr. 5, 1995

[51] Int. Cl.[6] ..... A63B 57/00

[52] U.S. Cl. ..... 273/33; 273/212

[58] Field of Search ..... 273/33, 202–212

[56] References Cited

U.S. PATENT DOCUMENTS

| | | | |
|---|---|---|---|
| 3,473,812 | 10/1969 | Pelzmann . | |
| 3,575,420 | 4/1971 | Turner et al. . | |
| 4,418,909 | 12/1983 | Messana | 273/33 |
| 4,786,054 | 11/1988 | Keys . | |
| 4,998,732 | 3/1991 | Gallant . | |
| 5,195,743 | 3/1993 | Walsh, Jr. . | |

*Primary Examiner*—V. Millin
*Assistant Examiner*—Steven B. Wong
*Attorney, Agent, or Firm*—Salter & Michaelson

[57] ABSTRACT

An improved golf tee consists of a tee head having a flat supporting surface, and an elongated stem depending from the tee head. A layer of adhesive material is disposed on the flat supporting surface to promote adhesion of the golf ball to the flat supporting surface. The flat tee head reduces surface area contact of the ball on the supporting surface, and thereby reduces friction, or spinning, forces when the ball leaves the surface of the tee. The result is a straighter, more accurately hit golf ball. In a second embodiment, the tee head includes an upwardly convex supporting surface having a layer of adhesive material thereon. The convex surface further reduces contact area between the golf ball and golf tee.

2 Claims, 2 Drawing Sheets

GOLF TEE

BACKGROUND AND SUMMARY OF THE INVENTION

The instant invention relates generally to golf tees, and more particularly to a golf tee having a flat or upwardly convex supporting surface for receiving a golf ball thereon.

Golf tees of varying configurations have heretofore been known in the art. In this regard, the Messana U.S. Pat. No. 4,418,909 represents the closest prior art to the subject invention of which the Applicant is aware. The Messana patent discloses a conventional golf tee having an upwardly concave socket for receiving a golf ball therein, and further discloses a double-sided adhesive pad received in the socket. The adhesive pad promotes adhesion of the ball within the socket. It is stated in Messana, that such adhesion within the socket provides anti-spin characteristics which reduce or prevent "hooks" and "slices."

In general, it is known that wooden golf tees are not manufactured according to exacting tolerances, and that therefore, there may be significant variations in the roundness of a golf tee socket. It is believed that such variances create varying levels of friction across the width of the surface of the golf ball as it leaves the tee surface. Varying friction across the width of the ball thus create spin forces on the ball as it leaves the tee socket, which forces are believed to promote hooking and slicing of the golf ball. Accordingly, it is a theory of the instant invention that variances in roundness of the tee socket create undesirable spin characteristics, which in fact promote hooking and slicing of the golf ball when hit.

The instant invention provides an improved golf tee comprising a tee head having a flat supporting surface, and an elongated stem depending from the tee head, and further comprising a layer of adhesive material disposed on the flat supporting surface to promote adhesion of the golf ball to the flat supporting surface. The flat tee head reduces surface area contact of the ball on the supporting surface, and thereby reduces friction forces when the ball leaves the surface of the tee. The result is a straighter, more accurately hit golf ball. In a second embodiment, the tee head includes an upwardly convex supporting surface having a layer of adhesive material thereon. The convex surface further reduces contact area between the golf ball and golf tee.

Accordingly, among the objects of the instant invention are: the provision of a golf tee which reduces surface area contact between the golf ball and the golf tee; the provision of a golf tee which reduces spinning forces on a golf ball which promote hooking and slicing; the provision of a golf tee having a flat supporting surface; the provision of a golf tee having an upwardly convex supporting surface; and the provision of a golf tee having a flat or upwardly convex supporting surface, and further including a layer of adhesive material to promote adhesion of the golf ball to the golf tee.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
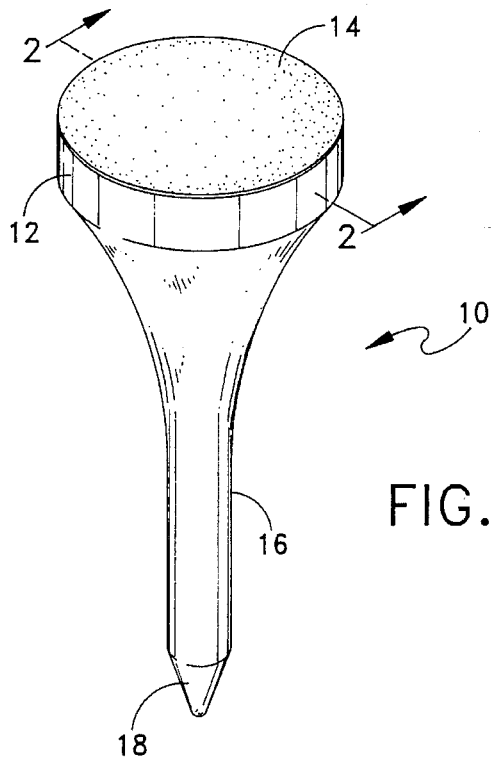
FIG. 1 is a perspective view of a first embodiment of a golf tee constructed in accordance with the instant invention.
Figure 2:
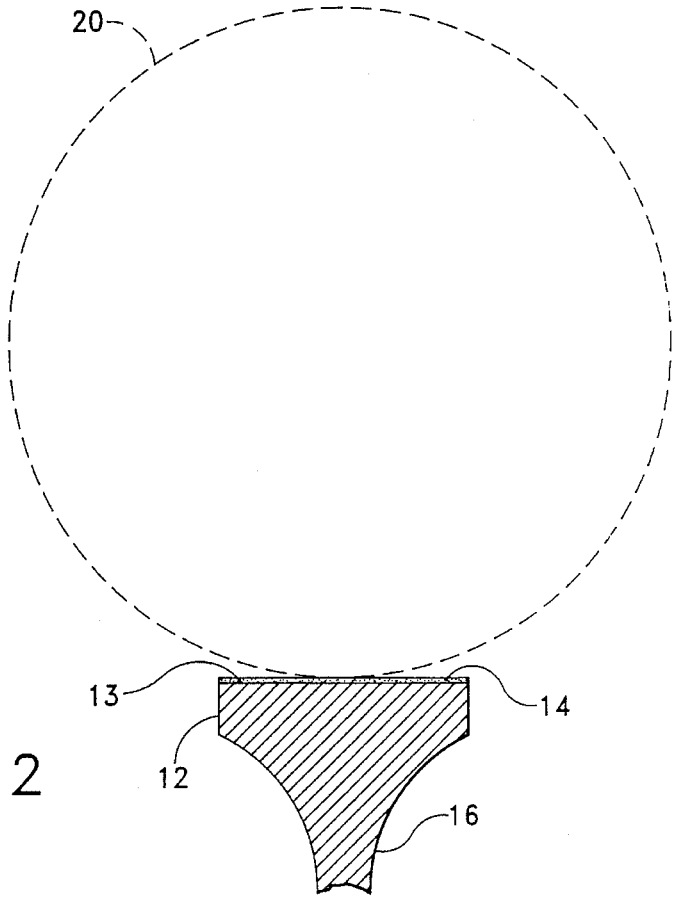
FIG. 2 is a cross-sectional view thereof taken along line 2—2 of FIG. 1.

Referring now to the drawings, a first embodiment of a golf tee is illustrated and generally indicated at 10 in FIGS. 1–2. The golf tee 10 comprises a tee head 12 having a substantially flat supporting surface 13, and an elongated stem 16 tapered to a point 18 at its bottom for insertion into the ground. The golf tee 10 further comprises a layer of adhesive material 14 disposed on the flat supporting surface 13. The tee head 12 and stem 16 are preferably constructed as a single piece from wood, metal, metal alloys, plastic materials, or composite materials. As illustrated in FIG. 2, the layer of adhesive material 14 is preferably thin, so as to minimize surface area contact, while simultaneously providing adhesion between a golf ball 20 (shown in broken lines) and the supporting surface 13 of the tee head 12. As further seen in FIG. 2, the area of surface contact between the golf ball 20 and the tee head 12 is very minimal. In fact, the surface contact area may only amount to a single dimple of the golf ball 20 in most cases.

The layer of adhesive material preferably comprises a double sided adhesive tape, or alternatively, can comprise a self-sticking adhesive applied directly to the supporting surface 13. In either event, the shear strength of the adhesive should be sufficient to maintain the ball in contact with the tee so that it may be hit without falling off the tee, yet not be so strong as to effect the rotation of the ball as it leaves the surface of the tee. It is believed that any one of a number of adhesive tapes, or other adhesive materials supplied by Minnesota Mining and Manufacturing Corporation (3M Corporation) would be suitable for the intended purpose. While the adhesive material 14 may provide some friction forces to the ball 20 in shearing away from the tee surface when hit, it is believed that such forces are much more uniform in distribution than encountered with a socket head tee. Therefore, the shearing forces are not believed to adversely affect the flight of the ball 20.

Figure 3:
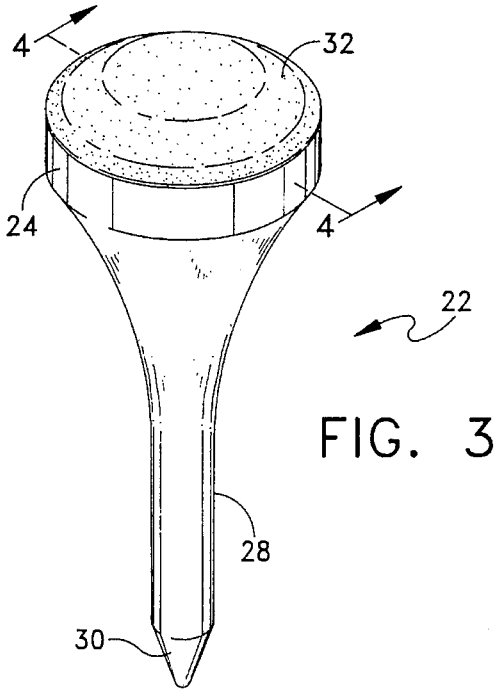
FIG. 3 is a perspective view of a second embodiment of the golf tee.
Figure 4:
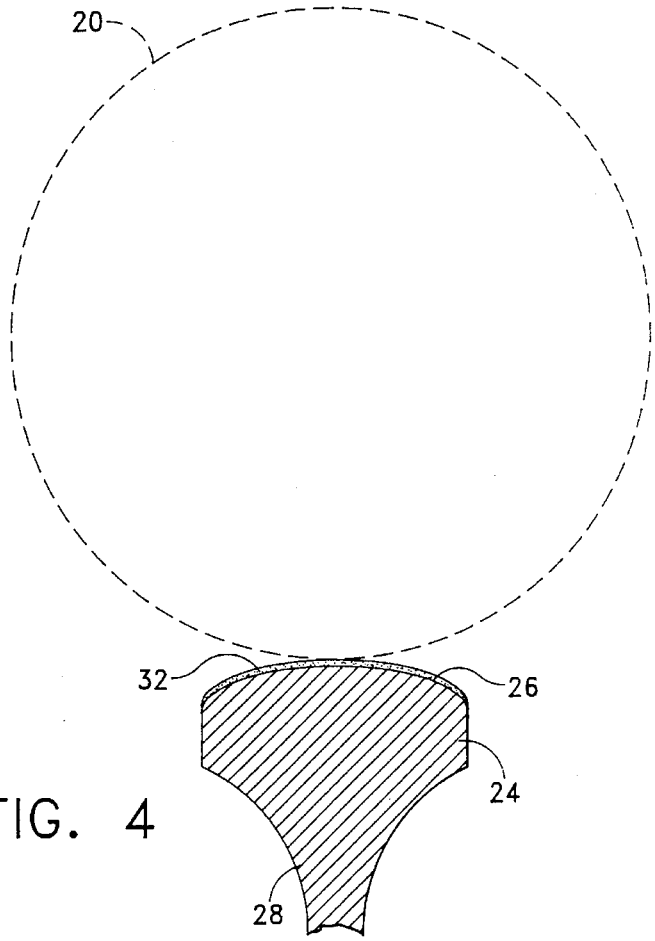
FIG. 4 is a cross-sectional view thereof taken along line 4—4 of FIG. 3.

Referring now to FIGS. 3–4, a second embodiment of the golf tee is illustrated and generally indicated at 22. The golf tee 22 is generally similar to the first embodiment 10. However, the tee head 24 is provided with a upwardly convex supporting surface 26 rather than a flat surface. An elongated stem 28 depends from the head 24 and is tapered to a point 30 at its bottom for insertion into the ground. The golf tee 22 also comprises a layer of adhesive material 32 disposed on the convex supporting surface 26. The upwardly convex surface 26 further reduces surface area contact between the golf ball 20 and the tee 22, and thereby minimizes friction, or spinning forces on the golf ball as it leaves the tee head 24.

It can therefore be seen that the instant invention provides unique and effective golf tees which minimize surface area contact between the golf ball and the tee, and thereby reduce friction, or spinning forces as the ball leaves the surface of the tee. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A golf tee comprising a tee head and an elongated stem depending from said tee head, said tee head including a flat supporting surface for supporting a golf ball thereon, said golf tee further comprising a layer of adhesive material disposed on said flat supporting surface.

2. A golf tee comprising a tee head and an elongated stem depending from said tee head, said tee head including an upwardly convex supporting surface for supporting a golf ball thereon, said golf tee further comprising a layer of adhesive material disposed on said upwardly convex supporting surface.

* * * * *